US007119743B2

(12) United States Patent
Iguchi et al.

(10) Patent No.: US 7,119,743 B2
(45) Date of Patent: Oct. 10, 2006

(54) ANTENNA AND ELECTRONIC DEVICE USING THE SAME

(75) Inventors: Akihiko Iguchi, Moriguchi (JP); Naoki Adachi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/524,582

(22) PCT Filed: Jun. 8, 2004

(86) PCT No.: PCT/JP2004/008269

§ 371 (c)(1),
(2), (4) Date: Feb. 15, 2005

(87) PCT Pub. No.: WO2004/109857

PCT Pub. Date: Dec. 16, 2004

(65) Prior Publication Data

US 2006/0152411 A1 Jul. 13, 2006

(30) Foreign Application Priority Data

Jun. 9, 2003 (JP) ..... 2003-163613

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 5,420,596 A * 5/1995 Burrell et al. ..... 343/700 MS
5,585,807 A * 12/1996 Takei ..... 343/702
5,966,097 A * 10/1999 Fukasawa et al. ... 343/700 MS
6,326,921 B1 12/2001 Egorov et al.
6,552,686 B1 * 4/2003 Ollikainen et al. .. 343/700 MS
6,650,294 B1 * 11/2003 Ying et al. ..... 343/700 MS
6,859,174 B1 * 2/2005 Kane et al. ..... 343/700 MS
2003/0098812 A1 5/2003 Ying et al.

FOREIGN PATENT DOCUMENTS

| | | | |
|---|---|---|---|
| EP | 1 128 466 | A2 | 8/2001 |
| JP | 01-228303 | A | 9/1989 |
| JP | 11-127014 | A | 5/1999 |
| JP | 2001-177326 | A | 6/2001 |
| JP | 2001-298313 | A | 10/2001 |
| JP | 2003-101335 | A | 4/2003 |
| WO | WO 2000/72404 | A1 | 11/2000 |
| WO | WO 2002/13312 | A1 | 2/2002 |

OTHER PUBLICATIONS

International Search Report for PCT/JP2004/008269, dated Aug. 3, 2004.
European Search Report for Application No. EP 04 74 5838, dated Mar. 29, 2006.

* cited by examiner

*Primary Examiner*—Tan Ho
(74) *Attorney, Agent, or Firm*—RatnerPrestia

(57) ABSTRACT

An antenna comprises a ground plate which is planar; a first power feed element which is disposed separately from the ground plate by a prescribed distance and which is formed in a prescribed shape; a first parasitic element which is planar and which is formed in a prescribed shape; a first shortcircuit part which electrically connects the first parasitic element and the ground plate; and a power feed part which is electrically connected with the first power feed element, wherein the first power feed element and the first parasitic element are disposed in parallel in part with each other, and the first power feed element and the first parasitic element have multiple resonances by electro magnetic coupling.

14 Claims, 5 Drawing Sheets

ANTENNA AND ELECTRONIC DEVICE USING THE SAME

THIS APPLICATION IS A U.S. NATIONAL PHASE APPLICATION OF PCT INTERNATIONAL APPLICATION PCT/JP/2004/008269 filed on Jun. 8, 2004.

TECHNICAL FIELD

The present invention relates to an antenna capable of being used for a radio communication device such as a mobile device.

BACKGROUND ART

A conventional built-in antenna will be described as follows with reference to Japanese Patent Laid-Open Application No. H01-228303. FIG. 8 shows an inverted-F antenna which has been conventionally used as a built-in antenna. The inverted-F antenna is formed of ground plate 104, radiating element 101, shortcircuit part 102 to shortcircuit between ground plate 104 and radiating element 101, and power feed part 103 to feed electric power into the antenna. To broaden the bandwidth of the conventional inverted-F antenna has required either extending the distance between radiating element 101 and ground plate 104 or increasing radiating element 101 in size. However, in the aforementioned inverted-F antenna, when the device having the antenna inside is designed to be thinner, it becomes impossible to secure the distance between ground plate 104 and radiating element 101 because ground plate 104 and a printed circuit board are laid horizontally, thereby making it difficult to broaden the bandwidth.

SUMMARY OF THE INVENTION

The antenna of the present invention comprises a ground plate which is planar; a first power feed element which is disposed separately from the ground plate by a prescribed distance and which is formed in a prescribed shape; a first parasitic element which is planar and which is formed in a prescribed shape; a first shortcircuit part which electrically connects the first parasitic element and the ground plate; and a power feed part which is electrically connected with the first power feed element, wherein the first power feed element and the first parasitic element are disposed in parallel in part with each other, and the first power feed element and the first parasitic element develop effective electromagnetic filed coupling so as to have multiple resonances.

DETAILED DESCRIPTION OF PREFERRED EMBODIMENTS

The antenna of the present invention includes a prescribed first power feed element and a first parasitic element which is planar and has a prescribed shape. The antenna is characterized in that the first power feed element and the first parasitic element are laid to be in parallel in part with each other, and the electro magnetic coupling between the first power feed element and the first parasitic element is developed effectively to broaden the frequency bandwidth.

The antenna of the present invention can further broaden the frequency bandwidth by forming the first power feed element and the first parasitic element in a meander shape and by winding these elements in the same direction so as to resonate the power feed element and the parasitic element more effectively.

The antenna of the present invention may further include a second power feed element which is branched from the first power feed element, and another parasitic element which is connected with a ground plate at a position different from the position where the first parasitic element is connected with the ground plate. Using the resonances of the plurality of power feed elements and the plurality of parasitic elements enables a plurality of frequency bandwidths to be broadened.

Each of the embodiments of the present invention will be described with reference to accompanying drawings.

First Exemplary Embodiment

Figure 1:
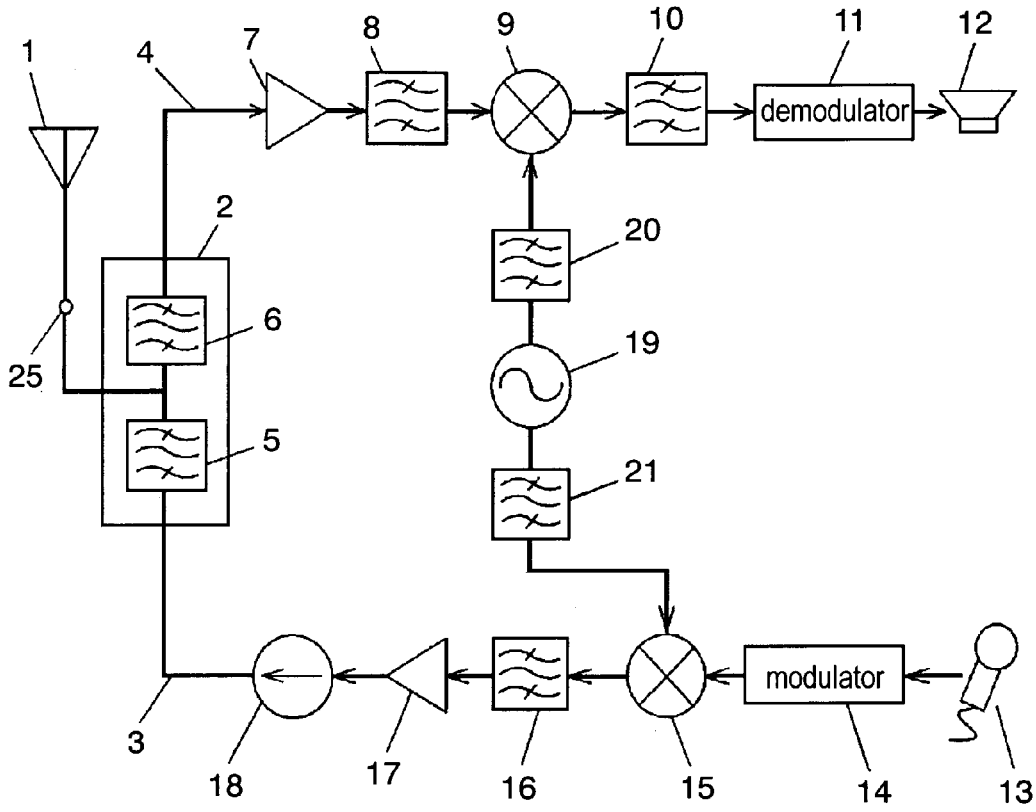
FIG. 1 is a circuit diagram of a portable phone.

FIG. 1 shows an electric circuit of a portable phone. As shown in FIG. 1, antenna 1 is connected to transmission line 3 and reception line 4 via antenna duplexer 2. Antenna duplexer 2 includes transmission filer 5 and reception filter 6. Electric wave received by antenna 1 is transmitted to reception line 4 via antenna duplexer 2, whereas transmission signals such as voice are transmitted from antenna 1 via transmission line 3 and antenna duplexer 2. The electric circuit of the portable phone shown in FIG. 1 is a general example, so it will be described only briefly. Reception line 4 is connected with speaker 12 via amplifier 7, interstage filter 8, mixer 9, IF filter 10 and demodulator 11. On the other hand, transmission line 3 has modulator 14, mixer 15, interstage filter 16, amplifier 17 and isolator 18 provided thereon in that order from microphone 13, and is connected to antenna duplexer 2. Mixers 9 and 15 are connected to voltage control oscillator (VCO) 19 via filters 20 and 21, respectively.

Figure 2:
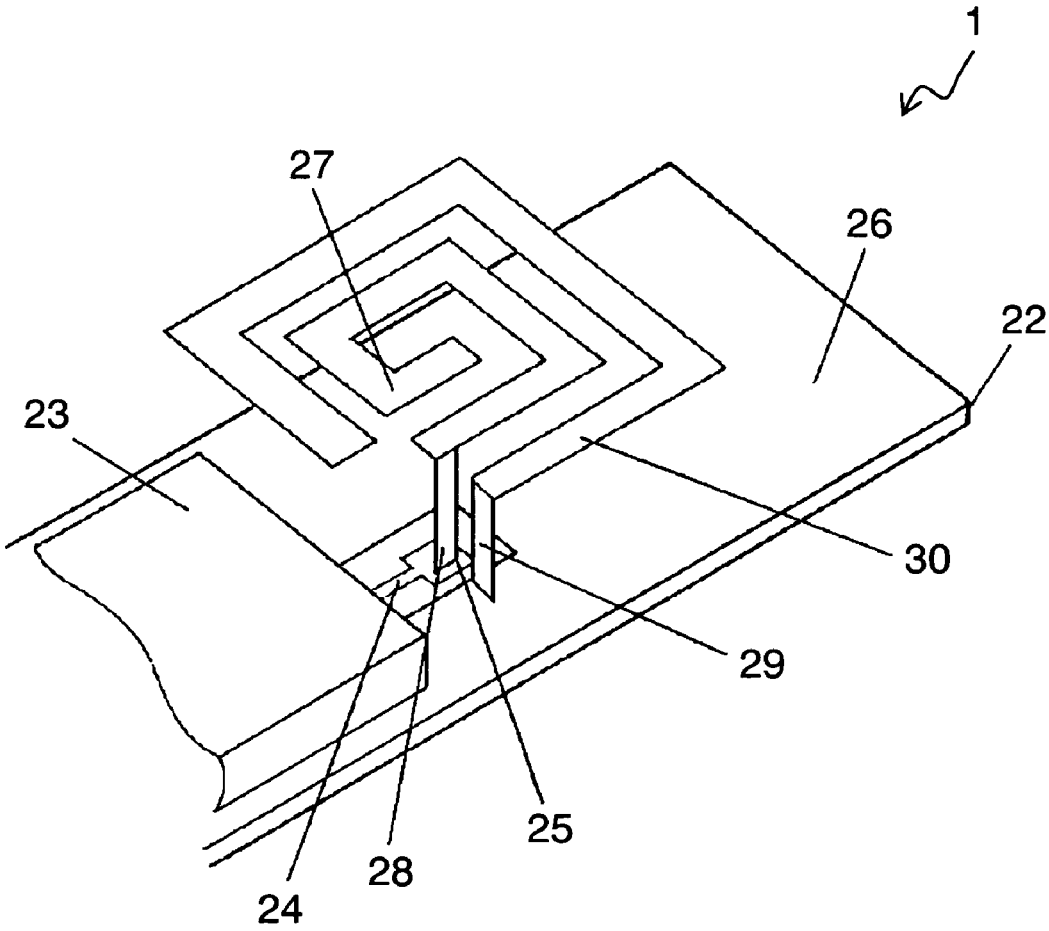
FIG. 2 is a block diagram of an antenna of a first embodiment of the present invention.

A device which has embodied this electric circuit is shown in FIG. 2. Transmission-reception circuit part 23 on printed circuit 22 includes reception line 4 formed of the components from antenna duplexer 2 to demodulator 11, and transmission line 3 formed of the components from antenna duplexer 2 to modulator 14. Transmission-reception circuit part 23 is connected with signal line 24 extending therefrom, and signal line 24 is connected with power feed terminal 25. Power feed terminal 25 is provided between antenna 1 and antenna duplexer 2 as shown in FIG. 1.

As shown in FIG. 2, antenna 1 includes printed circuit board 22; ground plate 26 made of a copper foil plate or the like formed on printed circuit board 22; first power feed element 27 made of a spiral copper plate which is disposed above ground plate 26 in such a manner as to face it with a prescribed distance therebetween; and power feed part 28 which electrically connects ground plate 26 and power feed element 27. Antenna 1 further includes first parasitic element 30 which is disposed to surround first power feed element 27 with a prescribed distance therebetween, and first shortcircuit part 29 which electrically connects first parasitic element 30 and ground plate 26.

The behavior of this antenna will be described as follows. In antenna 1 shown in FIG. 2, first power feed element 27 is fed a high frequency signal from power feed part 28, and first parasitic element 30 is fed a high frequency signal from first power feed element 27 by electro magnetic coupling, thereby achieving impedance matching.

In addition, impedance matching can be achieved in a desired frequency bandwidth by adjusting each element length and the strength of the electromagnetic coupling.

Figure 3:
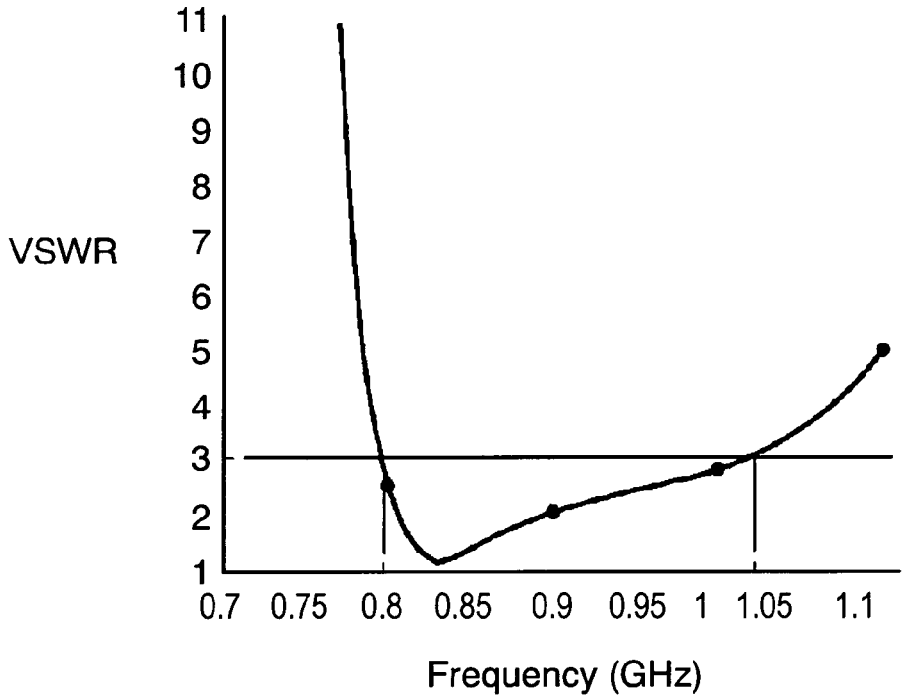
FIG. 3 is a view showing VSWR characteristics of the antenna of the present invention.
Figure 4:
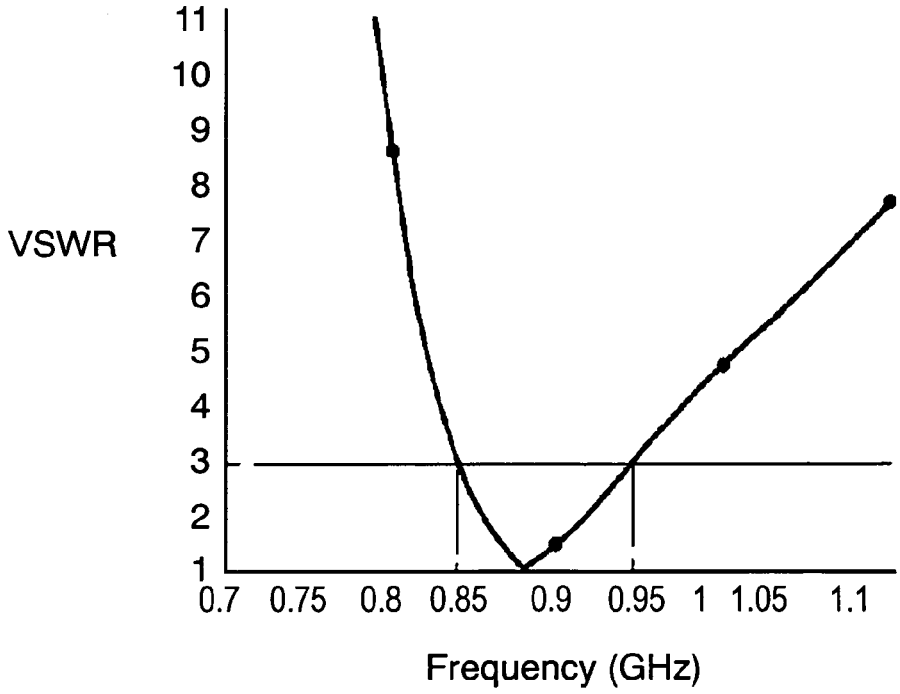
FIG. 4 is a view showing VSWR characteristics of a conventional inverted-F antenna.

Concerning the antenna structure of the present embodiment, a voltage standing wave ratio (hereinafter referred to as VSWR characteristics) corresponding to 900 MHz is shown in FIG. 3. On the other hand, the VSWR characteristics of an inverted-F antenna are shown in FIG. 4. A comparison in bandwidth at a VSWR of less than 3 (VSWR<3) indicates that antenna 1 of the present embodiment has a bandwidth of about 250 MHz, whereas the conventional inverted-F antenna has a bandwidth of about 100 MHz. In other words, the antenna of the present embodiment has more than twice as broad a bandwidth as the conventional antenna.

Thus the antenna of the present embodiment having first power feed element 27 and first parasitic element 30 can achieve bandwidth broadening since it results in being able to use the resonance between two elements.

Second Exemplary Embodiment

Figure 5:
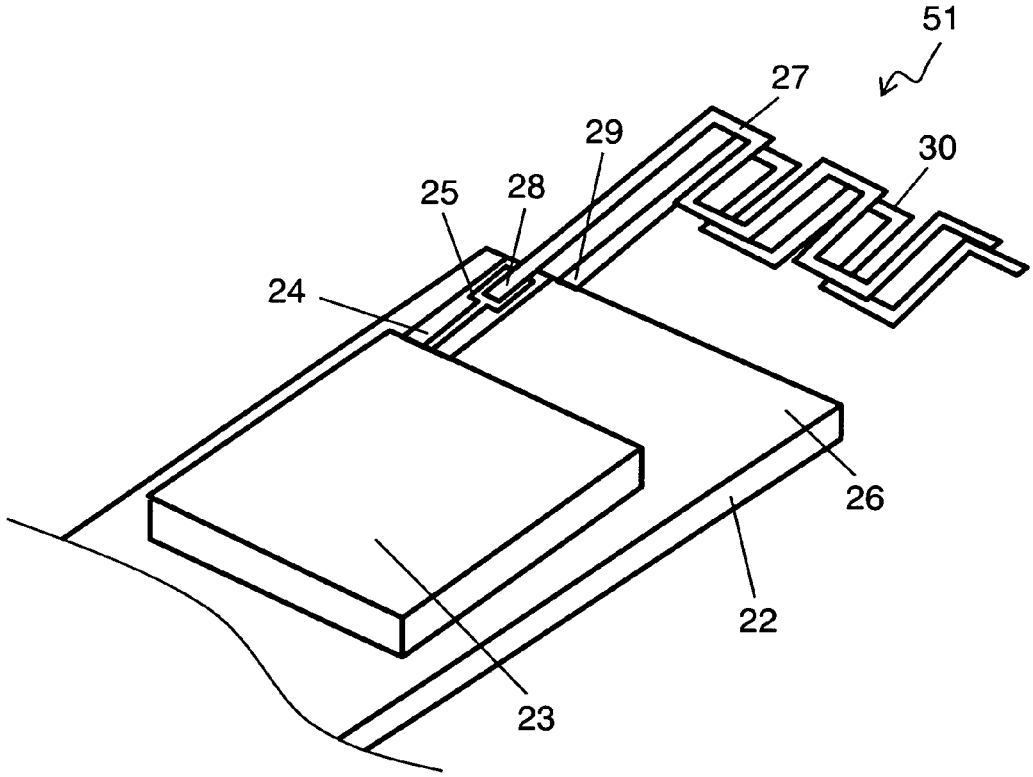
FIG. 5 is a block diagram of an antenna of a second embodiment of the present invention.

FIG. 5 shows antenna 51 of a second embodiment of the present invention.

Antenna 51 includes ground plate 26; first power feed element 27 which is projected from an end of ground plate 26 within the same plane as ground plate 26 and which is formed in a meander shape; and power feed part 28 which electrically connects ground plate 26 and first power feed element 27. Antenna 51 further includes first parasitic element 30 which faces first power feed element 27 with a predetermined distance therebetween. The first parasitic element is projected in the same direction as first power feed element 27, and is electrically connected with ground plate 26 via first shortcircuit part 29 provided at an end of the first parasitic element 30. In the secondt embodiment, the distance between first power feed element 27 and the first parasitic element 30 can be secured by disposing first parasitic element 30 lower than ground plate 26. Besides this solution, the in-between distance can be secured also by providing a step part at the end of printed circuit board 22 or by bending either first power feed element 27 or the first parasitic element at the end surface of ground plate 26.

In the antenna structure of the second embodiment, the positional relation between ground plate 26 and first power feed and parasitic elements 27, 30 allows first power feed and parasitic elements 27, 30 to be disposed in the extended direction of the end of the board so as to have multiple resonances by electromagnetic coupling. As a result, the influence of the ground plate on the antenna is reduced, thereby achieving broad bandwidth characteristics.

The elements are formed in a meander shape in the present embodiment; however, the same effects could be obtained by using spiral helical elements.

Third Exemplary Embodiment

Figure 6:
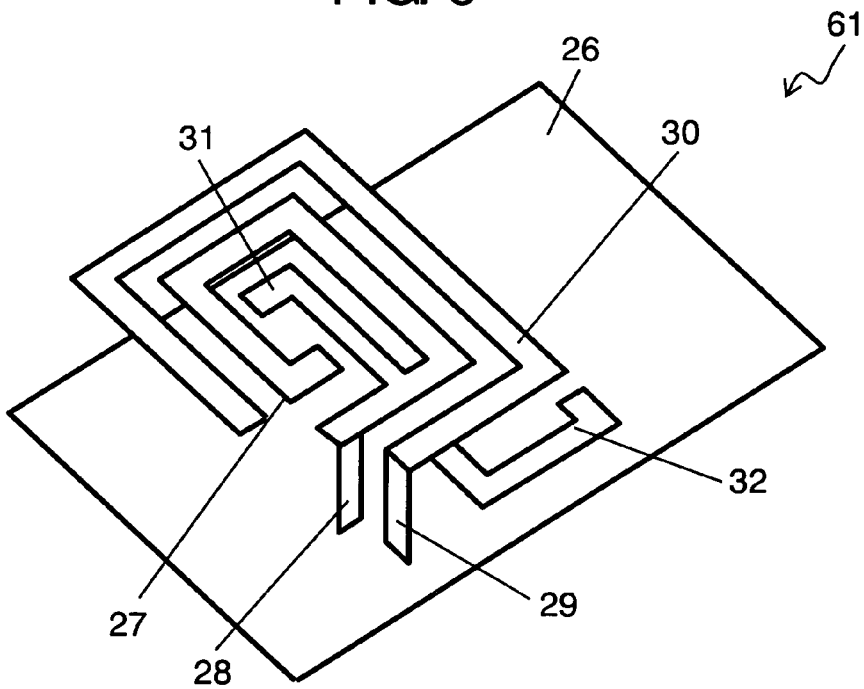
FIG. 6 is a block diagram of an antenna of a third embodiment of the present invention.

FIG. 6 shows antenna 61 of a third embodiment of the present invention.

Antenna 61 includes ground plate 26; first power feed element 27 which is disposed to face ground plate 26 and which is formed in a spiral shape; second power feed element 31 branched from first power feed element 27; power feed part 28 which feeds high frequency signals into first power feed element 27 and second power feed element 31; first parasitic element 30 which is disposed to surround first power feed element 27 with a desired distance therebetween; second parasitic element 32 which is branched from first parasitic element 30 and which is disposed separately from second power feed element 31 by a desired distance; and first shortcircuit part 29 which electrically connects first and second parasitic elements 30, 32 and ground plate 26.

Such use of first and second power feed elements 27, 31 and first and second parasitic elements 30, 32 makes it possible to broaden bandwidths in the frequency bands corresponding to the element lengths of the first and second power feed and parasitic elements.

Fourth Exemplary Embodiment

Figure 7:
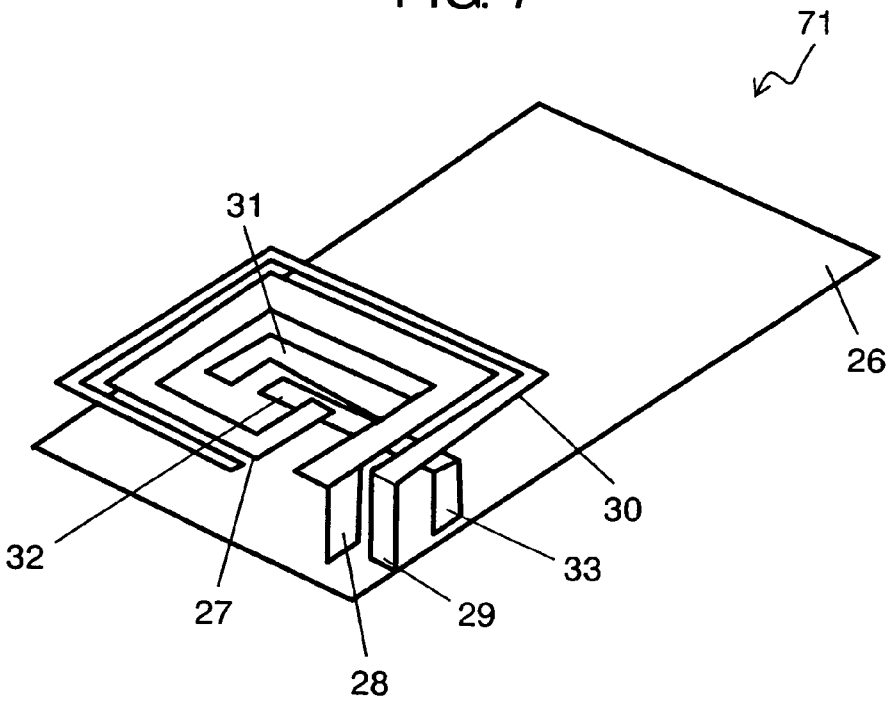
FIG. 7 is a block diagram of an antenna of a fourth embodiment of the present invention.
Figure 8:
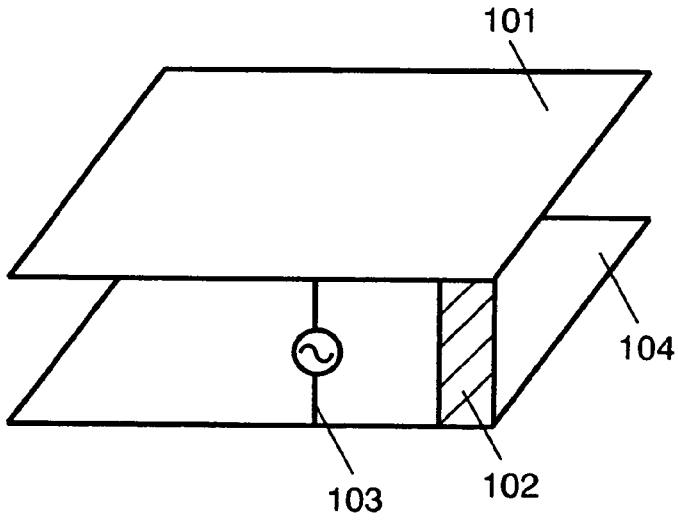
FIG. 8 PRIOR ART
FIG. 8 is a block diagram of the conventional inverted-F antenna.

FIG. 7 shows antenna 71 of a fourth embodiment of the present invention.

Antenna 71 includes ground plate 26; first power feed element 27 which is disposed to face ground plate 26 and which is formed in a spiral shape; second power feed element 31 branched from first power feed element 27; power feed part 28 which feeds high frequency signals into first power feed element 27 and second power feed element 31; first parasitic element 30 which is disposed to surround first power feed element 27 with a desired distance therebetween; and first shortcircuit part 29 which electrically connects parasitic elements 30 and ground plate 26. Antenna 71 further includes second parasitic element 32 which is disposed separately from second power feed element 31 by a desired distance; and second shortcircuit part 33 which connects second parasitic element 32 and ground plate 26. First shortcircuit part 29 and second shortcircuit part 33 are shortcircuited to ground plate 26 at different positions from each other.

By thus structuring antenna 71 and by using first and second power feed elements 27, 31 and first and second parasitic elements 30, 32, it becomes possible to broaden bandwidths in the frequency bands corresponding to the element lengths of the first and second power feed and parasitic elements. In addition, disposing the parasitic elements individually can increase the flexibility to adjust the electromagnetic coupling which is a matching requirement.

INDUSTRIAL APPLICABILITY

The antenna of the present invention is useful for electronic devices such as portable phones because of being compact and having a broad bandwidth.

The invention claimed is:

1. An antenna comprising:

a ground plate which is planar;

a first power feed element which is disposed separately from the ground plate by a prescribed distance and which is formed in a prescribed shape;

a second power feed element which is branched from the first power feed element;

a first parasitic element which is planar and which is formed in a prescribed shape;

a second parasitic element which is disposed to face the second power feed element;

a first shortcircuit part which electrically connects the first parasitic element and the ground plate;

a second shortcircuit part which connects the second parasitic element to the ground plate; and a power feed part which is electrically connected with the first power feed element, wherein the first power feed element and the first parasitic element are disposed in parallel in part with each other, and the first power feed element and the first parasitic element have multiple resonances by electro magnetic coupling.

2. The antenna according to claim 1, wherein the first power feed element and the first parasitic element are disposed to face the ground plate with a prescribed distance therebetween, and the first power feed element is surrounded by the first parasitic element.

3. The antenna according to claim 1, wherein the first parasitic element and the first power feed element face with each other with a prescribed distance therebetween.

4. The antenna according to claim 1 further comprising:

the second parasitic element which is branched from the first parasitic element.

5. The antenna according to claim 1, wherein the first power feed element and the first parasitic element are in a spiral shape and wound in a same direction as each other.

6. The antenna according to claim 1, wherein the first power feed element and the first parasitic element are in a helical shape and wound in a same direction as each other.

7. The antenna according to claim 1, wherein the first power feed element and the first parasitic element are in a meander shape and wound in a same direction as each other.

8. An electronic device connected with an antenna, said antenna comprising:

a ground plate which is planar;

a first power feed element which is disposed separately from the ground plate by a prescribed distance and which is formed in a prescribed shape;

a second power feed element which is branched from the first power feed element;

a first parasitic element which is planar and which is formed in a prescribed shape;

a second parasitic element which is disposed to face the second power feed element;

a first shortcircuit part which electrically connects the first parasitic element and the ground plate;

a second shortcircuit part which connects the second parasitic element to the ground plate; and a power feed part which is electrically connected with the first power feed element, wherein the first power feed element and the first parasitic element are disposed in parallel in part with each other, and the first power feed element and the first parasitic element have multiple resonances by electro magnetic coupling.

9. An electronic device according to claim 8, wherein the first power feed element and the first parasitic element are disposed to face the ground plate with a prescribed distance therebetween, and the first power feed element is surrounded by the first parasitic element.

10. An electronic device according to claim 8, wherein the first parasitic element and the first power feed element face with each other with a prescribed distance therebetween.

11. An electronic device according to claim 8, wherein the second parasitic element which is branched from the first parasitic element.

12. An electronic device according to claim 8, wherein the first power feed element and the first parasitic element are in a spiral shape and wound in a same direction as each other.

13. An electronic device according to claim 8, wherein the first power feed element and the first parasitic element are in a helical shape and wound in a same direction as each other.

14. An electronic device according to claim 8, wherein the first power feed element and the first parasitic element are in a meander shape and wound in a same direction as each other.

* * * * *